United States Patent [19]

Müller et al.

[11] Patent Number: 4,995,023

[45] Date of Patent: Feb. 19, 1991

[54] WATCHCASE AND WATCH PROVIDED WITH SUCH CASE

[75] Inventors: Jacques Müller, Reconvilier; Clément Meyrat, Le Landeron, both of Switzerland

[73] Assignee: ETA SA Fabriques d'Ebauches, Switzerland

[21] Appl. No.: 460,456

[22] Filed: Jan. 3, 1990

[30] Foreign Application Priority Data

Jan. 13, 1989 [CH] Switzerland ..... 00096/89

[51] Int. Cl.[5] ..... G04B 37/00

[52] U.S. Cl. ..... 368/276; 368/309

[58] Field of Search ..... 368/276-287, 368/309

[56] References Cited

U.S. PATENT DOCUMENTS 3,986,335 10/1976 Harper ..... 368/276
4,086,753 5/1978 Tsuchiya ..... 368/276
4,229,936 10/1980 Schneider ..... 368/282
4,396,298 8/1983 Ripley ..... 368/300
4,459,038 7/1984 Lederrey ..... 368/276

FOREIGN PATENT DOCUMENTS 3120799 12/1982 Fed. Rep. of Germany .
2122286 1/1972 France .
2510776 2/1983 France .
11396 10/1895 Switzerland .

*Primary Examiner*—Vit W. Miska
*Attorney, Agent, or Firm*—Pollock, Vande Sande & Priddy

[57] ABSTRACT

A case for a wrist watch the caseband (12) of which bears lugs (17) and the back cover (10) of which is provided with a central rib (26) and radial ribs (28*a*, 28*b*, 28*c*). The peripheral end of certain radial ribs (28*a*, 28*c*) coincides with the line of extension of each lug (17).

9 Claims, 4 Drawing Sheets

WATCHCASE AND WATCH PROVIDED WITH SUCH CASE

This invention concerns a watch case of the type including a caseband and a back cover. It concerns more particularly cases in which a portion in the form of a dome and a stiffening structure together define a back cover and a caseband. In these cases the stiffening structure appears as an additional thickness of the dome portion. It includes a central projection and stiffening elements extending radially from the central projection towards the dome periphery.

BACKGROUND OF THE INVENTION

A watch case of this type is described in Swiss patent No. CH 11396. This watch, advantageously fashioned of gold, is provided with a back cover including such a stiffening structure. The latter enables the obtaining of a thin back cover which is nevertheless rigid. In this manner, it is possible to reduce the weight of the case to the minimum and thereby provide a gold watch the price of which remains moderate.

In the abovementioned patent, the case is intended for a pocket watch. As the name indicates, watches of this type are in principle maintained in a pocket, i.e. within a protected place little sensitive to mechanical stresses.

To the contrary, in the case of wrist watches, the watch case is subjected to numerous stresses brought about for instance by traction on the bracelet or by lateral shocks. Such shocks generally occur in the neighbourhood of the position corresponding to the midday of the watch.

A purpose of this invention is to provide wrist watch cases in which it is possible to avoid all deformations due to the bracelet traction and to reduce the risk of deformation brought about by a shock.

SUMMARY OF THE INVENTION

To this end, the watch cases according to the invention are characterized in that, comprising lugs, certain of the stiffening elements terminate at the periphery of the dome in the attachment zone of the lugs.

According to a preferred embodiment as defined by claim 2, the case includes an opening permitting the replacement of a power cell and a removable cover for blocking the opening. Such a case, in spite of the fineness of its walls, thus permits easy changing of the power cell, even by the wearer.

According to another special embodiment defined by claim 4, it is possible to obtain a passage for a control stem which is secure and watertight in spite of the small thickness of the case walls.

The invention also has as its objective a watch provided with a watch case as defined in claim 9. The characteristics of this watch are such that even when the case is of gold it may be watertight, sturdy and nevertheless inexpensive.

The invention will be better understood upon reading the description to follow of an embodiment thereof taken in connection with the drawings.

DESCRIPTION OF THE PREFERRED EMBODIMENT

Figure 1:
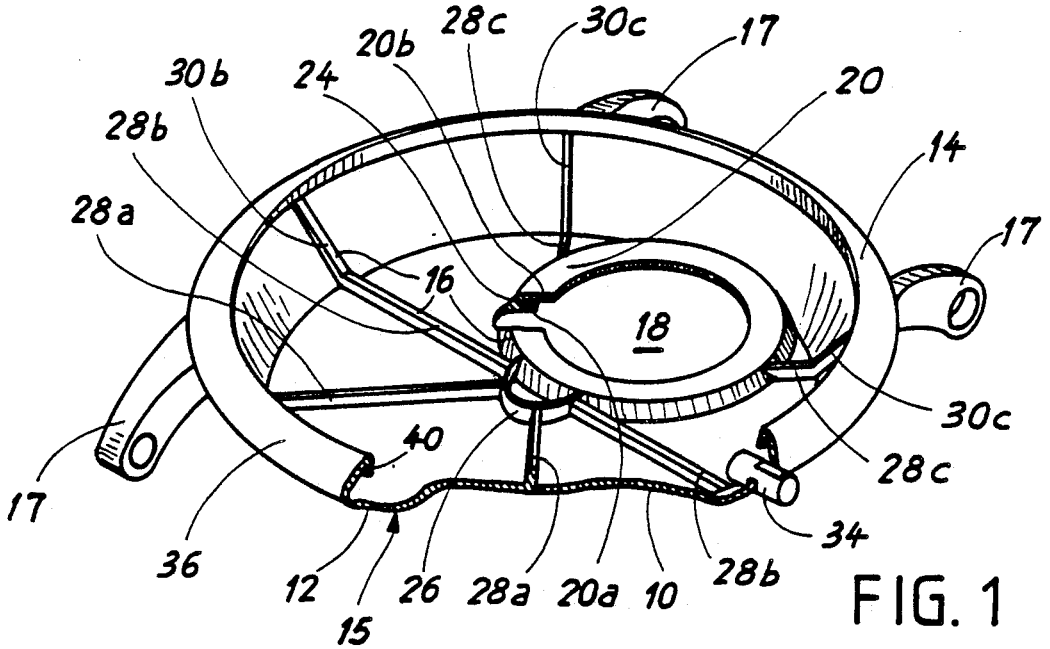
FIG. 1 is a perspective view with cutaway portions of a watch case according to the invention.

The watch case shown on the drawing includes a back cover 10, a caseband 12 and a bezel 14, all three being integrally obtained from a single piece. It is formed by a thin dome 15 and a stiffening structure 16 as additional dome thickness and integral with the internal face of the dome 15. The caseband 12 bears four lugs or horns bearing reference 17 welded to its outer face. The back cover 10 includes a circular opening 18, the periphery of which is defined by a ring 20 forming part of the stiffening structure 16. The opening 18 has as its function to enable replacement of the power cell intended to energize a watch movement adapted to be housed within the watch case. Opening 18 occupies a position comprised between the center of the back cover and the two lugs placed on either side of midday of the watch. In the finished watch, as will be explained in further detail with reference to FIG. 4, this opening is blocked by a cover fixed to the watch case by a bayonet catch.

In order to permit such engagement, ring 20 comprises more particularly a first portion **20*a* extending from the back cover 10 towards the interior of the case and a second portion 20*b* forming a flange and extending radially towards opening 18** in order to define the periphery thereof.

Figure 2:
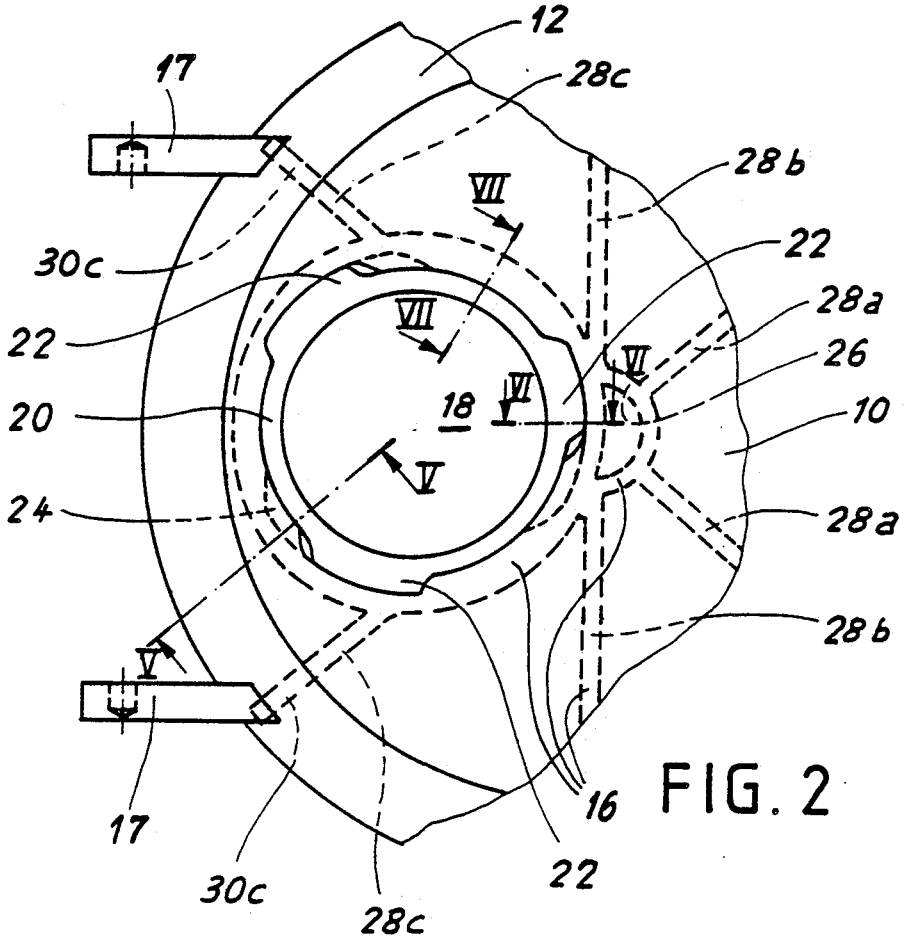
FIG. 2 is a plan view from below of a portion of the watch case of FIG. 1.
Figure 6:
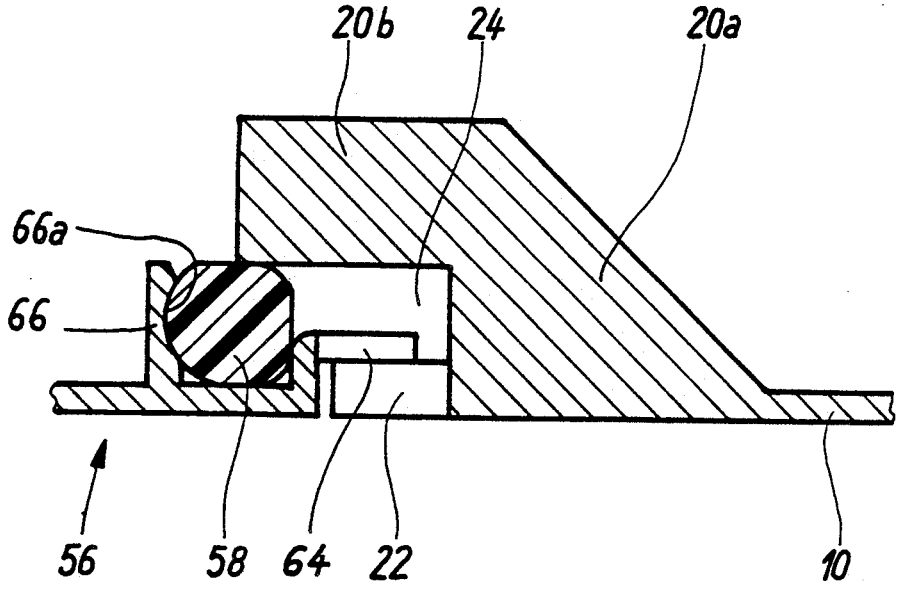
Figure 7:
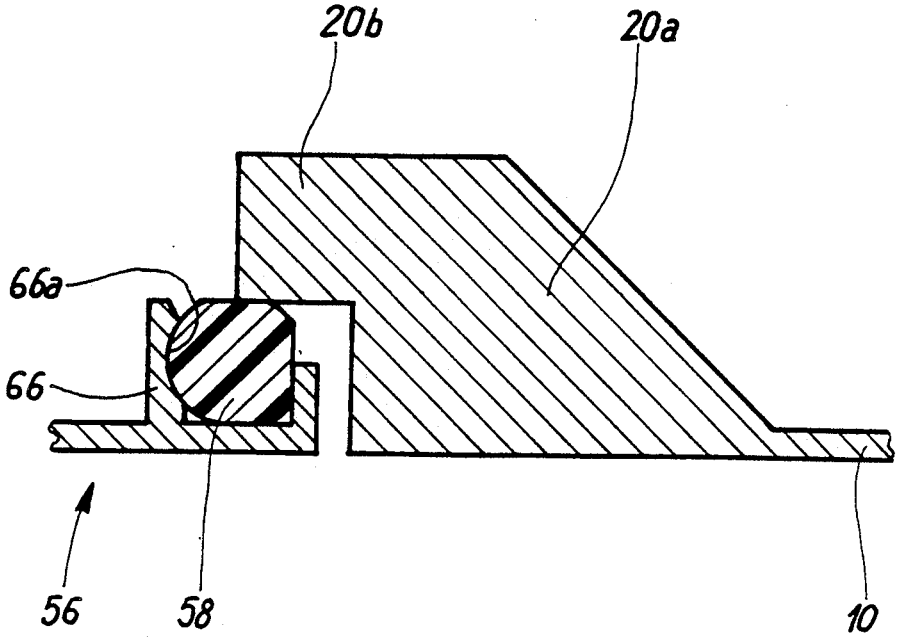

Thus, as may be seen on FIG. 2, ring 20 includes three cells 22 open from the side of the opening 18. They extend over the entire height of the first portion **20*a*. Grooves 24 open into cells 22 in the extension of the outer surface of flange 20*b* (FIG. 6**).

The stiffening structure 16 further includes ribs integral with dome 15 and contiguous to its internal face, one being central, the others radial. The central rib, bearing reference 26 (FIGS. 1 and 2), is in the form of a segment of a circle, the ends of which are joined to the wall 20. Two radial ribs bearing references **28*a* extend from central rib 26 toward lugs 17 placed on either side of six o'clock. Two other radial ribs referenced 28*b* extend from the central rib 26 toward the periphery in elongation of one another and aligned along the axis three o'clock–nine o'clock. Finally, two radial ribs referenced 28*c* extend from wall 20 towards lugs 17** located on either side of midday.

Figure 3:
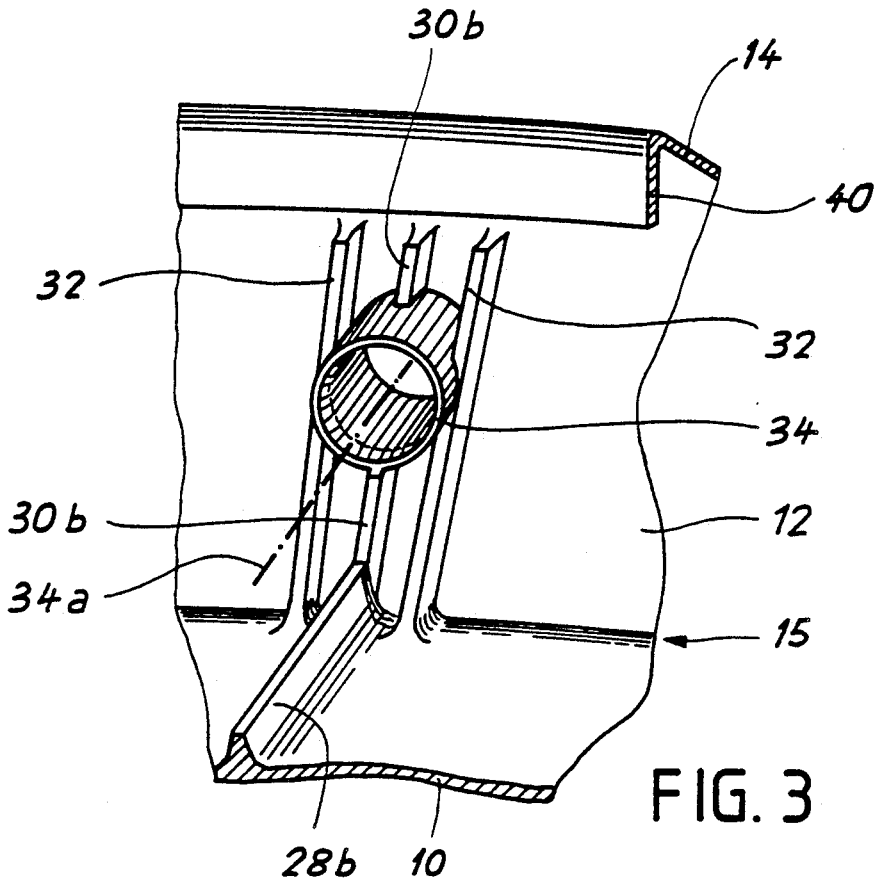
FIG. 3 is a perspective view of an enlarged detail of the watch case of FIG. 1.

The portion of the watch case forming the caseband 12 and integral with back cover 10 exhibits a flared out form. It is provided on its inner face with ribs **30*a*, 30*b* and 30*c* extending respectively the radial ribs 28*a*, 28*b* and 28*c* as well as two ribs 32 (FIG. 3**) in reference to which further details will be given hereinafter.

Caseband 12 bears at three o'clock a tube 34 (FIGS. 1, 3 and 4) intended to accommodate a time setting stem. One may see on FIG. 3 that the axis **34*a* of tube 34 is parallel to one of the radial ribs referenced 28*b*. This tube 34 passes through a caseband rib referenced 30*b* which is located along the extension of radial rib 28*b***.

Furthermore, the two ribs 32 (FIG. 3) are located on either side of tube 34 and extend substantially parallel to rib 30*b*.

Tube 34 is welded to caseband 12 not only at the part defined by the dome 15, but further to ribs 30*b* and 32. The connection tube-to-caseband is thus considerably reinforced and the risk of deterioration sharply reduced.

Figure 4:
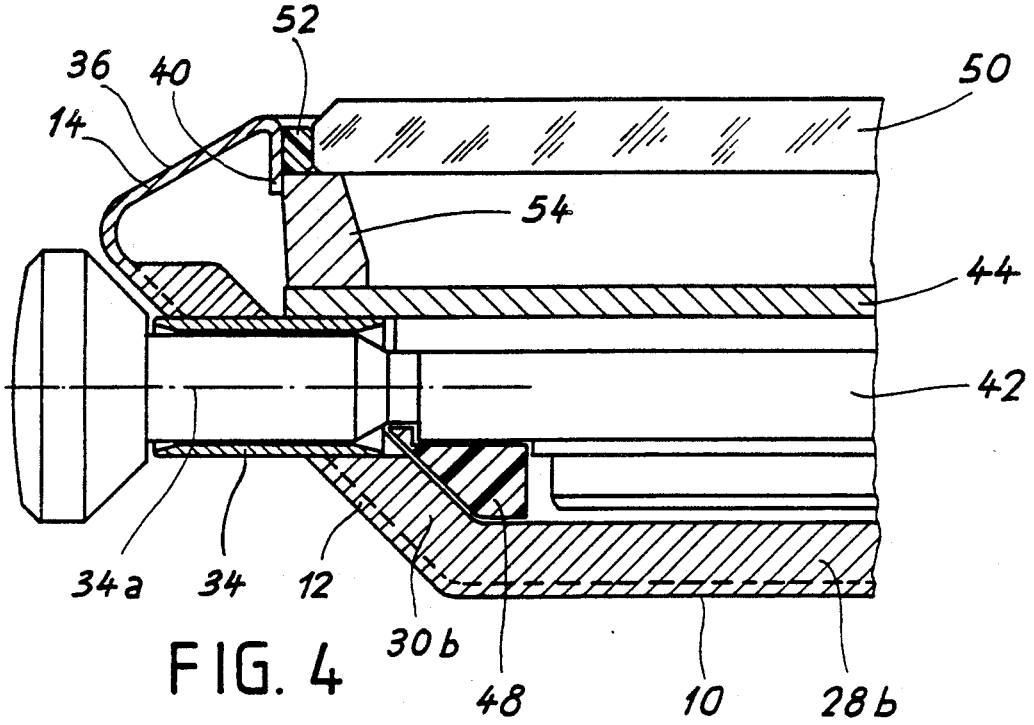
FIG. 4 shows a cross-section passing through the tube for the control stem of a watch provided with a case such as shown on FIGS. 1 to 3.

The portion of the watch case forming bezel 14 is also integral with caseband 12 and back cover 10 (FIGS. 1 and 4). It comprises a first portion of truncated form the base of which is connected to the most flared portion of caseband 12 and which defines the upper face 36 of the case as well as a flange 40 of cylindrical form and which extends towards the interior of the case. Its function will be set forth in detail subsequently.

A watch case such as described hereinabove may advantageously be obtained by swaging and upsetting employing a rotary press such as that sold by the H. Schmid Company (Rapperswil, Switzerland) under the designation T200. In this type of press the punch and the die are not only given a translation movement tending to bring them together, but as well a rotational movement around the translation axis and a swinging movement about an axis perpendicular to the translation axis.

To obtain such a watch case, the person skilled in the art begins by cutting out a pellet from a gold sheet. Such pellet is then formed by means of the rotary press as abovementioned, the latter being successively provided with punch-die pairs which through their combined movements deform the material to the point where the case as shown on the drawing is obtained After forming, the watch case is further subjected to finishing operations, the purpose of which is to guarantee a pleasing surface state.

By proceeding thus, it is possible to obtain a watch case in which the dome 15 has a constant thickness of 0.15 mm over the back cover 10 and the caseband 12 as well as over the bezel 14. The additional thickness due to the stiffening structure 16 is equal to 0.65 mm.

On FIGS. 4 to 8 may be seen in cross-section an assembled watch including a case such as has just been described hereinabove. This watch includes additionally (FIGS. 4 and 5) a movement 42 on which is mounted a dial 44 and hands which are not shown. Movement 42 is positioned in the case by a casing ring 48. A crystal 50 is engaged in the opening defined by flange 40, with the interposition of a sealing gasket 52, and supported against a spacing flange 54 interposed between crystal 50 and dial 44.

Figure 5:
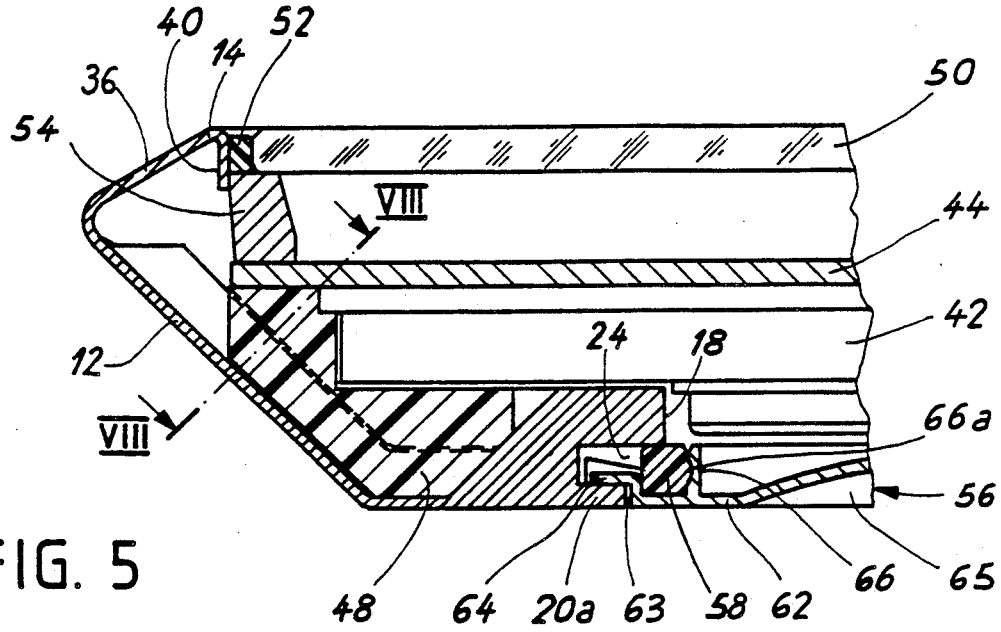
FIGS. 5 to 7 are cross-sections taken at various places of the power cell opening of this watch, respectively along lines V—V, VI—VI and VII—VII of FIG. 2.
Figure 8:
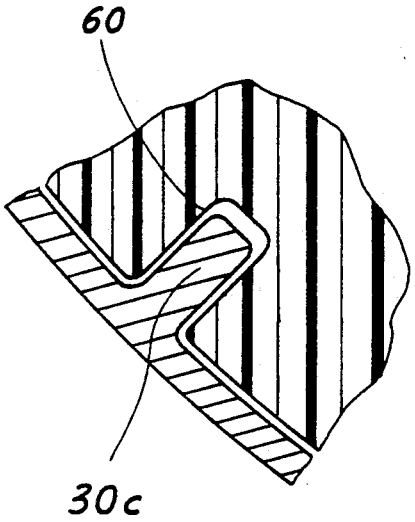
FIG. 8 is a partial cross-section of the watch taken along line VIII—VIII of FIG. 5.

Opening 18 as included in back cover 10 is blocked by a cover 56 and a seal 58 (FIG. 5).

In this watch the casing ring 48 is advantageously formed of injected plastic material and its form is such as to match that of the interior of caseband 12. The exterior of ring 48 is thus truncated, its surface being hollowed out with grooves 60 (FIG. 8) in which ribs 30*a*, 30*b*, 30*c* of caseband 12 are engaged. In this manner, the position of the casing ring 48 is completely defined axially, radially and angularly. The casing up of such a watch is particularly easy. Following assembly of dial 44 and the hands onto the movement, this latter is engaged in the casing ring 48, the assembly thus formed being then introduced into the case and positioned, thanks to ribs 30*a*, 30*b*, 30*c* engaged in grooves 60. The spacing flange 54, the diameter of which is slightly greater than the diameter of the cylindrical wall 40, is then driven in to bear against dial 44 which assures blocking the assembly in the case. Crystal 50 and its sealing gasket 52 are finally put into place in the standard manner so as to close the case from the upper side.

Thus, as has been said, cover 56 serves to close in a sealed manner opening 18 intended to permit changing the power cell. Cover 56 includes a thin disc 62 (FIG. 5) with a flange 63 turned towards the interior of the case and from which three lugs 64 extend radially, one thereof being visible on FIGS. 5 and 6. Disc 62 has a diameter slightly less than the inner diameter of the first portion 20*a*. The lugs 64 extend beyond disc 62 and exhibit a form which is complementary to that of cells 22. The central part of disc 62 is provided with a slot 65 the function of which will be indicated hereinafter.

Cover 56 further comprises a tubular portion 66 (FIGS. 5 to 7) welded to or integral with disc 62 and which extends towards the interior of the movement. This tubular portion 66 has a diameter slightly less than that of opening 18 so as to be able to penetrate therein. Portion 66 includes a groove 66*a* in which is housed seal 58.

To fasten cover 56 to the case it is sufficient to place it in a manner such that lugs 64 engage with cells 22, to press on cover 56 until lugs 64 bear on the portion forming flange 20*b* of ring 20, thereby compressing seal 58, and finally to rotate cover 56, for example by means of a coin introduced into slot 65. The lugs each then penetrate into one of grooves 24. In this manner the cover is subjected to an axial pressure due to the deformation of seal 58 and such pressure guarantees that cover 56 is maintained in place.

The wrist watch thus obtained includes a gold case which, although including walls which are particularly thin, retains nevertheless strength which is entirely adequate.

It is of course well understood that cases such as those described could also be made of materials other than gold without diminishing the mechanical qualities of the case. In such instances, however, the economy obtained in the quantity of material employed is much less important than for the instance where the watch case is of gold or other precious metal.

Finally, it should be noted that the cover could be eliminated in particular where the watch would be provided with a movement not employing a power cell.

What we claim is:

1. A watch case comprising a dome, lugs attached to the outer face of said dome and defining zones of attachment, and a stiffening structure obtained from the dome material which together define a back cover and caseband, said structure including, as additional dome thickness, a central projection integral with said back cover, and stiffening elements extending radially from said projection towards the dome periphery, certain of said stiffening elements terminating at the caseband of the dome in the attachment zones of the lugs to the dome.

2. A watch case as set forth in claim 1 wherein the back cover includes an off-center opening for permitting passage of a power cell, said opening being defined by a ring forming part of said stiffening structure, wherein the central projection takes the form of a curve segment the ends of which are in contact with a wall portion of said ring, and wherein said case further comprises a cover blocking said opening at least partially engaged in said opening and fastened to said back cover by a bayonet catch.

3. A watch case as set forth in claim 1 wherein said stiffening elements also extend over an internal face of the portion of the dome defining the caseband and elongate the stiffening elements integral with the portion of the dome forming the back cover.

4. A watch case as set forth in claim 3 wherein the caseband bears a tube intended to accommodate a control stem, said tube having an axis parallel to one of said stiffening elements borne by the back cover, wherein the tube passes through the stiffening element borne by the caseband as an elongation of said one back cover stiffening element one and wherein the caseband further bears two elements located on either side of said tube.

5. A watch case as set forth in claim 1 wherein the dome is extended in its upper portion by a cantilevered said flange being, itself extended by a wall projecting towards the back cover and defining a cylindrical surface forming an opening, the flange and the wall forming a bezel.

6. A watch case as set forth in claim 1 wherein the thicknesses of the dome in the portions thereof defining the back cover and the caseband are equal.

7. A watch case as set forth in claim 5 wherein the thicknesses of the flange and the wall are equal to that of the dome.

8. A watch case as set forth in claim 1 formed from a gold-based alloy.

9. A watch provided with a watch case as set forth in claim 5 which further includes a casing ring, a movement mounted in the casing ring and bearing a dial, a ring forming a flange, a crystal and a sealing gasket wherein:

the casing ring includes grooves in which said stiffening elements are engaged in order to position said ring;

the ring forming the flange is clamped in the opening formed by said wall and supported on the dial; and the crystal closes said opening by being fastened to the wall with interposition of said sealing gasket and axially positioned by the flange and bearing thereon.

* * * * *

PRINTER'S TRIM LINE

UNITED STATES PATENT AND TRADEMARK OFFICE

CERTIFICATE OF CORRECTION

PATENT NO. : 4,995,023

DATED : February 19, 1991

INVENTOR(S) : Jacques Muller and Clement Meyrat

It is certified that error appears in the above-identified patent and that said Letters Patent is hereby corrected as shown below:

Column 5, line 10, after "element" delete "one".

Column 5, line 11, after "elements" insert --one--.

Column 5, line 13, after "cantilevered" insert --flange,--, and after "being" delete ",".

Signed and Sealed this

Twenty-third Day of June, 1992

*Attest:*

DOUGLAS B. COMER

*Attesting Officer*

*Acting Commissioner of Patents and Trademarks*